US010022584B2

(12) United States Patent
Chang

(10) Patent No.: US 10,022,584 B2
(45) Date of Patent: Jul. 17, 2018

(54) STATIONARY EXERCISE BICYCLE WITH HORIZONTAL FLYWHEEL

(71) Applicant: Cheng-Cheng Chang, Taipei (TW)

(72) Inventor: Cheng-Cheng Chang, Taipei (TW)

( * ) Notice: Subject to any disclaimer, the term of this patent is extended or adjusted under 35 U.S.C. 154(b) by 0 days.

(21) Appl. No.: 15/406,799

(22) Filed: Jan. 16, 2017

(65) Prior Publication Data

US 2017/0216655 A1 Aug. 3, 2017

(30) Foreign Application Priority Data

Feb. 1, 2016 (CN) ..... 2016 2 0100463 U

(51) Int. Cl.

| | |
|---|---|
| ***A63B 22/00*** | (2006.01) |
| ***A63B 21/22*** | (2006.01) |
| ***A63B 22/02*** | (2006.01) |
| ***A63B 22/06*** | (2006.01) |
| ***A63B 21/00*** | (2006.01) |

(52) U.S. Cl.

CPC ..... *A63B 21/225* (2013.01); *A63B 21/4034* (2015.10); *A63B 22/0076* (2013.01); *A63B 22/02* (2013.01); *A63B 22/0605* (2013.01); *A63B 22/0664* (2013.01)

(58) Field of Classification Search

None

See application file for complete search history.

(56) References Cited

U.S. PATENT DOCUMENTS

| | | | | |
|---|---|---|---|---|
| 3,467,373 | A * | 9/1969 | Justice | A63B 21/225 244/1 R |
| 3,964,742 | A * | 6/1976 | Carnielli | A61H 1/0214 482/62 |
| 4,341,058 | A * | 7/1982 | Chun | A01D 34/6806 482/57 |
| 4,533,136 | A * | 8/1985 | Smith | A63B 22/0605 482/64 |
| 4,592,544 | A * | 6/1986 | Smith | A63B 22/0605 482/64 |
| 4,673,177 | A * | 6/1987 | Szymski | A63B 21/015 482/119 |
| 4,743,011 | A * | 5/1988 | Coffey | A63B 21/0088 482/111 |
| 5,013,033 | A * | 5/1991 | Watterson | A63B 22/0076 482/127 |
| 5,092,581 | A * | 3/1992 | Koz | A63B 69/06 434/247 |
| D377,672 | S * | 1/1997 | Wanzer | D21/663 |
| 6,030,320 | A * | 2/2000 | Stearns | A63B 22/0664 482/51 |
| 6,740,010 | B2 * | 5/2004 | Sze | A61H 1/0214 482/4 |
| 7,731,637 | B2 * | 6/2010 | D'Eredita | A63B 21/154 482/138 |

(Continued)

*Primary Examiner* — Stephen R Crow

(74) *Attorney, Agent, or Firm* — Chun-Ming Shih

(57) ABSTRACT

An exercise machine such as a stationary exercise bicycle includes a body supported by the ground; an axle disposed in the body; a first gear disposed on the axle; a driving shaft vertically disposed in the body; a second gear disposed on the driving shaft and meshed the first gear; and a horizontally disposed flywheel disposed in a base of the body. A rotation of the axle rotates the flywheel via the first gear, the second gear, and the driving shaft.

6 Claims, 4 Drawing Sheets

(56) References Cited

U.S. PATENT DOCUMENTS

| | | | | |
|---|---|---|---|---|
| 7,862,484 | B1 * | 1/2011 | Coffey | A63B 21/157 482/72 |
| 8,550,962 | B2 * | 10/2013 | Piaget | A63B 22/0056 482/52 |
| 8,808,150 | B2 * | 8/2014 | Choi | A63B 69/16 482/57 |
| 9,061,174 | B2 * | 6/2015 | Jun | A63B 21/00196 |
| 2003/0166438 | A1 * | 9/2003 | Gramaccioni | A63B 21/225 482/72 |
| 2017/0216655 | A1 * | 8/2017 | Chang | A63B 21/225 |

* cited by examiner

STATIONARY EXERCISE BICYCLE WITH HORIZONTAL FLYWHEEL

BACKGROUND OF THE INVENTION

1. Technical Field

The invention relates to exercise machines and more particularly to a stationary exercise bicycle having a horizontally disposed flywheel.

2. Related Art

An exercise machine can be any machine used for physical exercise. A wide variety of exercise machines including treadmills, weight machines, stretch trainers, exercise bicycles, elliptical trainers, and rowing machines, are commercially available.

A flywheel is a rotating mechanical device that is used to store rotational energy. Flywheels have an inertia called the moment of inertia and thus resist changes in rotational speed. Conventionally, many types of exercise machines are equipped with a flywheel. For example, a conventional stationary exercise bicycle comprises a body for supporting a seat, handlebars and a flywheel; two pedals rotatably attached to the body and operatively connected to the flywheel; an adjustable abutment pad mechanically in contact with the flywheel; a rear support tube adapted to receive a seat tube, the seat tube slidably located in the rear support tube; and a seat adjustment support.

The flywheel is disposed vertically with respect to the ground. However, the vertically disposed flywheel has the drawback of occupying more space. Further, it is not in the trend of providing a compact exercise machine.

Thus, the need for improvement still exists.

BRIEF SUMMARY

The invention has been made in an effort to solve the problems of the prior art including bulkiness by providing a stationary exercise bicycle having a horizontally disposed flywheel.

It is therefore an object of the invention to provide an exercise machine comprising a body supported by the ground; an axle disposed in the body; a first gear disposed on the axle; a driving shaft vertically disposed in the body; a second gear disposed on the driving shaft and meshed the first gear; and a horizontally disposed flywheel disposed in a base of the body and including a rotating shaft; wherein a rotation of the axle rotates the flywheel via the first gear, the second gear, and the driving shaft.

Preferably, the axle is horizontally or vertically disposed.

Preferably, both the first and second gears are bevel gears.

Preferably, further comprises a transmitting assembly under the driving shaft, the transmitting assembly being driven by the driving shaft to rotate the flywheel.

Preferably, the transmitting assembly includes a first grooved wheel placed on an end of the driving shaft, a second grooved wheel placed on the rotating shaft, and a belt disposed on both the first grooved wheel and the second grooved wheel.

Preferably, the transmitting assembly comprises a first gear member and a second gear member co-rotated with the flywheel by meshing the first gear member.

Preferably, the flywheel is in a frame of the body and the frame is a portion of the body.

Preferably, the body is implemented as a frame supported by the ground.

Preferably, the exercise machine is an exercise bicycle, a treadmill, a weight machine, a stretch trainer, an elliptical trainer, or a rowing machine.

The invention has the following advantageous effects in comparison with the prior art: The horizontally disposed flywheel can lower gravity of the body, thereby stabilizing the body. The horizontally disposed flywheel can save space to make a compact body.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
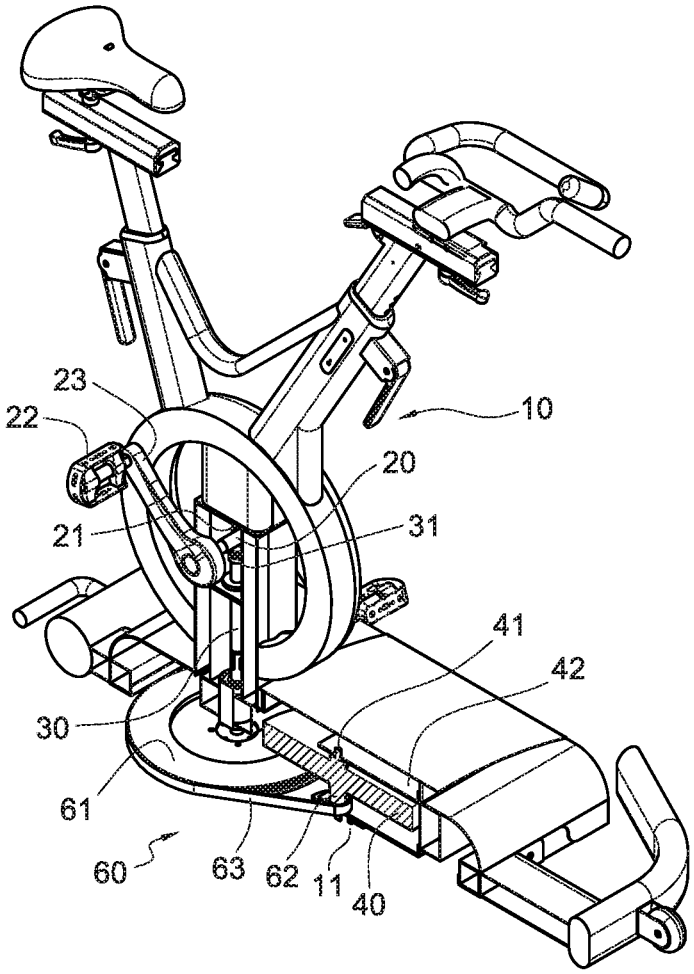
FIG. 1 is a perspective view of an exercise machine according to the invention.
Figure 2:
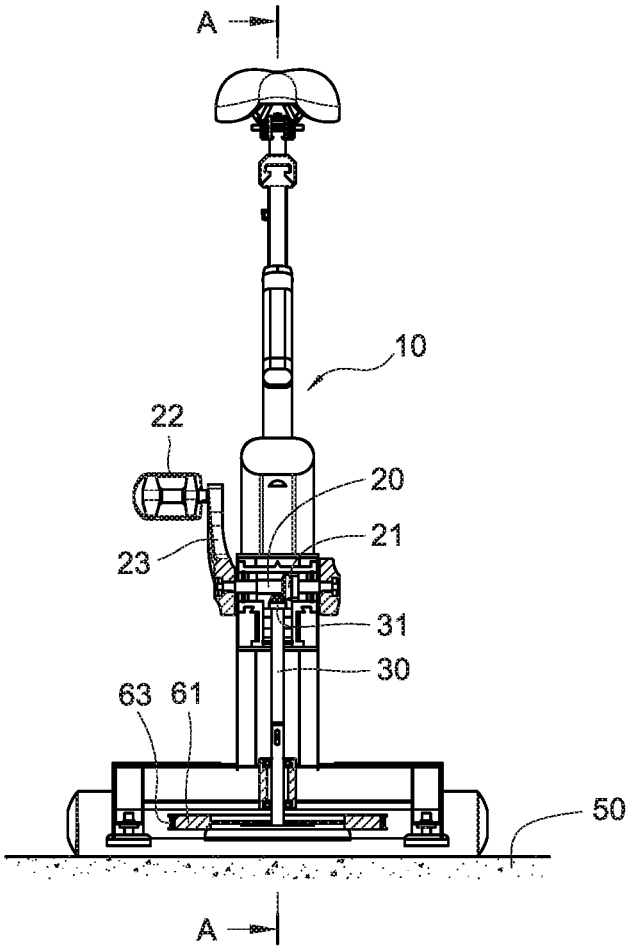
FIG. 2 is a longitudinal sectional view of FIG. 1.
Figure 3:
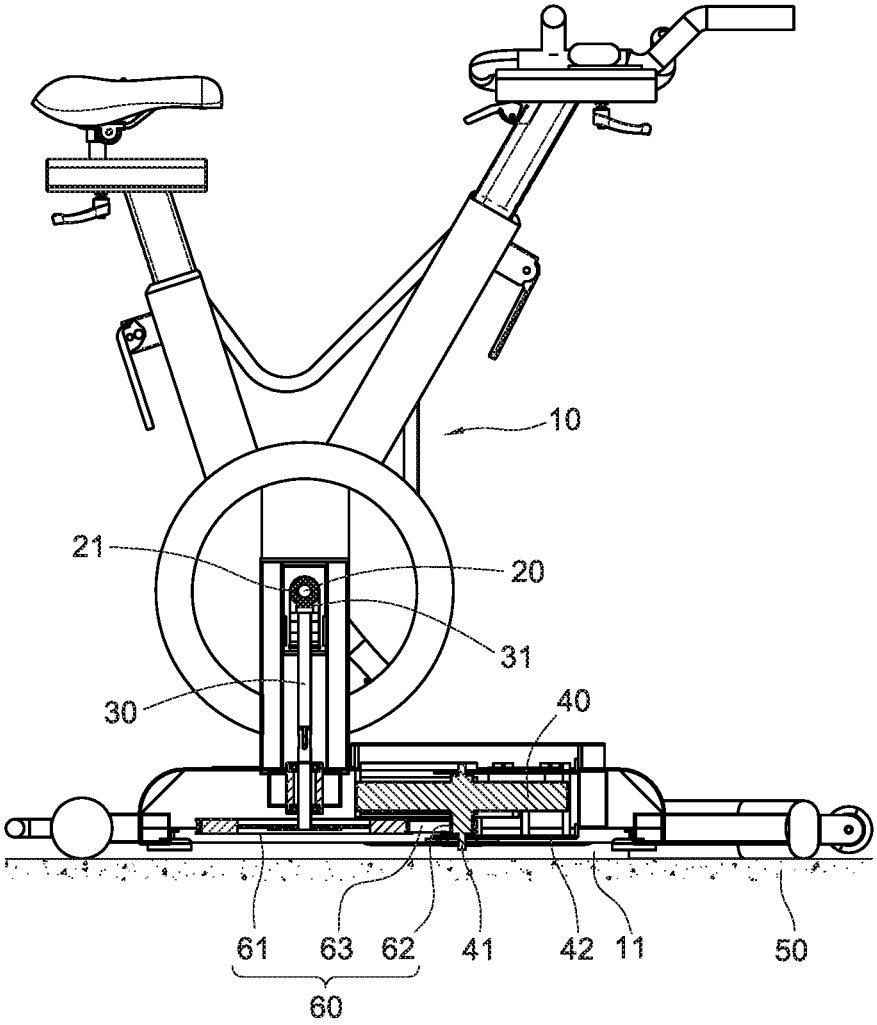
FIG. 3 is a sectional view taken along line A-A of FIG. 2.
Figure 4:
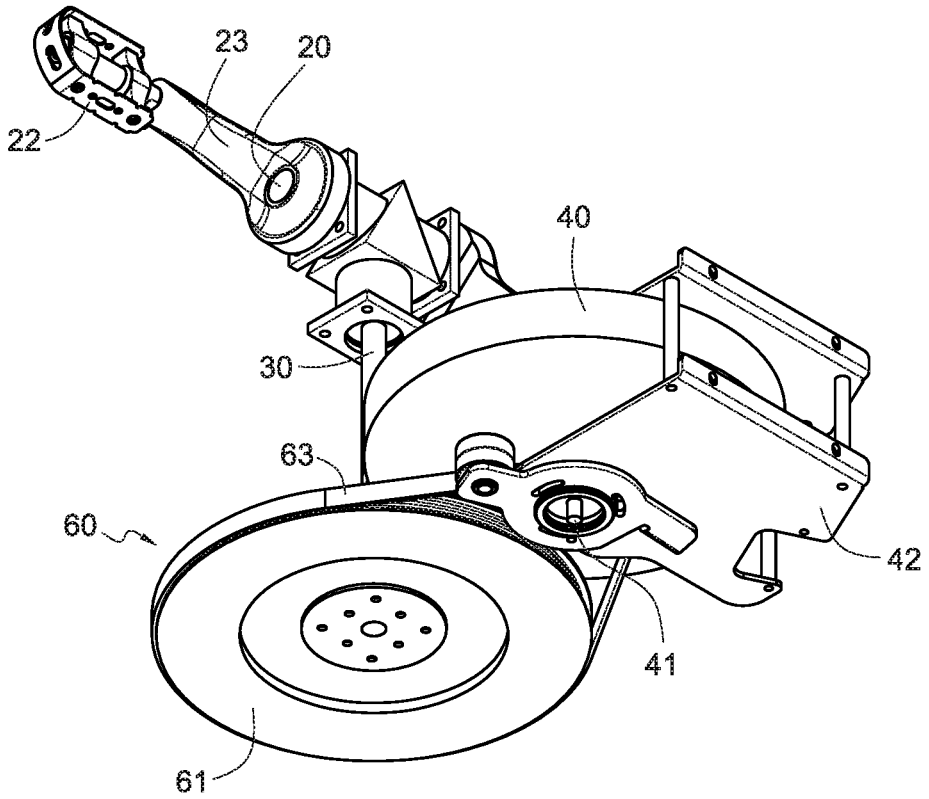
FIG. 4 is a perspective view of the flywheel and associated components.

Referring to FIGS. 1 to 4, an exercise machine (e.g., stationary exercise bicycle) in accordance with the invention comprises a body 10 supported by the ground 50, a driving shaft 30, a horizontally disposed flywheel 40, and an axle 20.

A gear 21 is integrally formed on a position of the axle 20 proximate to a central portion of the axle 20. Two crank arms 23 are provided at two ends of the axle 20 respectively. Two pedals 22 each are provided at one end of the crank arm 23. A person may pedal the pedals 22 to rotate the crank arms 23 about the axle 20 to achieve the purpose of physical exercise.

The driving shaft 30 is vertically disposed, i.e., perpendicular to the ground 50. The driving shaft 30 includes a gear 31 on a top. The gears 21 and 31 are meshed. In the embodiment as shown, both the gears 21 and 31 are bevel gears. Alternatively, other types of gears are possible within the scope of the invention. Still alternatively, the gear 21 may be disposed vertically and the gear 31 may be disposed horizontally in other embodiments.

The flywheel 40 is disposed horizontally and is disposed in a wide base 11 of the body 10. The flywheel 40 includes a rotating shaft 41 rotatably disposed through a housing 42 which is provided on the base 11.

The exercise machine further comprises a transmitting assembly 60 under the driving shaft 30. The transmitting assembly 60 includes a first grooved wheel 61 disposed around an end of the driving shaft 30 and driven by the driving shaft 30, a second grooved wheel 62 placed on the rotating shaft 41, and a belt 63 disposed on both the first grooved wheel 61 and the second grooved wheel 62. Alternatively, the belt 63 is eliminated, the first grooved wheel 61 is replaced with a first gear, and the second grooved wheel 62 is replaced with a second gear meshed the first gear in other embodiments.

The flywheel 40 is disposed in a frame of the body 10 and the frame is a portion of the body 10. Alternatively, the frame is the whole portion of the body 10 and is supported by the ground 50.

In addition to the exercise bicycle, the exercise machine can be implemented as a treadmill, a weight machine, a stretch trainer, an elliptical trainer, or a rowing machine.

In an exercise, a person may pedal the pedals 22 to rotate the axle 20. And in turn, the gear 21 rotates to turn the gear 31. And in turn, the gear 31 rotates the driving shaft 30. And in turn, the driving shaft 30 rotates the first grooved wheel 61. And in turn, the driven first grooved wheel 61 rotates the second grooved wheel 62 via the belt 63. And in turn, the second grooved wheel 62 rotates the rotating shaft 41. Finally, the rotating shaft 41 rotates the flywheel 40 to store rotational energy in the flywheel 40.

The invention has the following advantageous effects in comparison with the prior art: The horizontally disposed flywheel 40 can lower gravity of the body 10, thereby stabilizing the body 10. The horizontally disposed flywheel 40 can save space to make a compact body 10.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. An exercise machine comprising:

a body supported by the ground;

an axle disposed in the body;

a first gear disposed on the axle;

a driving shaft vertically disposed in the body;

a second gear disposed on the driving shaft and meshed the first gear; and a horizontally disposed flywheel disposed in a base of the body and including a rotating shaft;

wherein a rotation of the axle rotates the horizontally disposed flywheel via the first gear, the second gear, and the driving shaft, and wherein the driving shaft is non-coaxial to the rotating shaft.

2. The exercise machine of claim 1, wherein both the first and second gears are bevel gears.

3. The exercise machine of claim 1, further comprising a transmitting assembly under the driving shaft, the transmitting assembly being driven by the driving shaft to rotate the horizontally disposed flywheel, wherein the transmitting assembly includes a first driving wheel and a second driving wheel, the second driving wheel is coaxially connected to the rotating shaft of the horizontally disposed flywheel, such that the second driving wheel is driven by the first driving wheel to bring the horizontally disposed flywheel into rotation.

4. The exercise machine of claim 3, wherein the first driving wheel is a first grooved wheel, the second driving wheel is a second grooved wheel, the first and second grooved wheels are driven by a belt.

5. The exercise machine of claim 1, wherein the horizontally disposed flywheel is in a frame of the body and the frame is a portion of the body.

6. The exercise machine of claim 1, wherein the body is implemented as a frame supported by the ground.

* * * * *